US012768050B2

(12) United States Patent
Senderos et al.

(10) Patent No.: US 12,768,050 B2
(45) Date of Patent: Oct. 20, 2026

(54) METHODS FOR MANUFACTURING COLD SPRAYED POWDER METALLURGY PREFORM

(71) Applicant: The Boeing Company, Arlington, VA (US)

(72) Inventors: Bruno Zamorano Senderos, Huntsville, AL (US); Ali Yousefiani, Tustin, CA (US); Scott Cummings, Long Beach, CA (US)

(73) Assignee: The Boeing Company, Arlington, VA (US)

( * ) Notice: Subject to any disclaimer, the term of this patent is extended or adjusted under 35 U.S.C. 154(b) by 24 days.

(21) Appl. No.: 18/885,940

(22) Filed: Sep. 16, 2024

(65) Prior Publication Data

US 2026/0078496 A1 Mar. 19, 2026

(51) Int. Cl.

| | |
|---|---|
| ***C23C 24/04*** | (2006.01) |
| ***B22F 7/04*** | (2006.01) |
| ***C23C 24/08*** | (2006.01) |

(52) U.S. Cl.

CPC ..... *C23C 24/04* (2013.01); *B22F 7/04* (2013.01); *C23C 24/087* (2013.01); *B22F 2007/042* (2013.01)

(58) Field of Classification Search

CPC ..... C23C 24/04; C23C 24/087; B22F 7/04; B22F 2007/042

See application file for complete search history.

(56) References Cited

U.S. PATENT DOCUMENTS

2008/0152801 A1* 6/2008 DeBiccari ..... C23C 24/04 427/201
2023/0073429 A1* 3/2023 Kumta ..... B29C 64/194

FOREIGN PATENT DOCUMENTS

JP 6619141 B2 12/2019

* cited by examiner

*Primary Examiner* — Nathan T Leong
(74) *Attorney, Agent, or Firm* — Walters & Wasylyna LLC

(57) ABSTRACT

A method for manufacturing a cold sprayed powder metallurgy preform, the method including cold spraying a first metallic powder composition onto a substrate to yield a cold sprayed body and cold spraying a second metallic powder composition over the cold sprayed body to yield a cold sprayed canning layer on the cold sprayed body, wherein the cold sprayed canning layer includes a porosity of at most 3 percent.

20 Claims, 13 Drawing Sheets

METHODS FOR MANUFACTURING COLD SPRAYED POWDER METALLURGY PREFORM

FIELD

The present disclosure generally relates to cold spraying, more particularly, to methods for manufacturing cold sprayed powder metallurgy preforms for hot isostatic pressing.

BACKGROUND

Conventional cold spraying processes face significant challenges, particularly in terms of cost and efficiency. One of the main issues is the use of expensive propellant gases like helium, which are necessary to accelerate the metal powder to high speeds, ensuring minimal porosity in the end product. Although this results in a final product with less than 4% porosity, the prohibitive cost of these gases makes the process economically burdensome. While additive manufacturing, specifically cold spraying, is generally more cost-effective due to minimal waste and reduced need for additional materials, the expense of helium as propellant gas can negate these benefits. Therefore, there is a need to explore more economical alternatives, such as using nitrogen gas as a propellant. However, nitrogen is less effective at accelerating the powder, resulting in a higher porosity in the cold-sprayed body, which necessitates further processing steps like heat treating and hot isostatic pressing (HIPing) to reduce porosity levels. An alternative gas Hydrogen is under investigation with similar performance to helium but with significant safety challenges to overcome.

The challenge with using nitrogen gas lies in the increased porosity of the cold-sprayed body before HIPing. High porosity can prevent the isostatic pressing pressure from being applied evenly on the surface of the article, due to surface connected porosity, leading to defects and lack of compaction. To address this issue, an additional canning layer can be added to the cold-sprayed body. This layer acts as an isostatic pressure transfer mediating layer and should have less than 2% porosity. Developing a method to create this canning layer on a cold-sprayed body with higher porosity, produced using a slower but cheaper gas like nitrogen, is desirable. By implementing this solution, it is possible to achieve the economic advantages of using nitrogen while still ensuring the quality and integrity of the final product through effective HIPing.

Accordingly, those skilled in the art continue with research and development efforts in the field of cold sprayed powder metallurgy preform.

SUMMARY

Disclosed are methods for manufacturing cold sprayed powder metallurgy preform.

In one example, the disclosed method for manufacturing cold sprayed powder metallurgy preform includes cold spraying a first metallic powder composition onto a substrate to yield a cold sprayed body and cold spraying a second metallic powder composition over the cold sprayed body to yield a cold sprayed canning layer on the cold sprayed body, wherein the cold sprayed canning layer comprises a porosity of at most 3 percent.

In another example, the disclosed method for manufacturing cold sprayed powder metallurgy preform using at least a first metallic powder composition and a second metallic powder composition includes cold spraying the first metallic powder composition onto a substrate to yield a cold sprayed body that has a porosity of at least 4 percent, cold spraying the second metallic powder composition over the cold sprayed body to yield a cold sprayed canning layer on the cold sprayed body, the cold sprayed canning layer that has a porosity of at most 3 percent, wherein the cold sprayed body and the cold sprayed canning layer define a cold sprayed powder metallurgy preform, and hot isostatic pressing the cold sprayed powder metallurgy preform.

Also disclosed are cold sprayed powder metallurgy preform that is manufactured by the disclosed method.

In one example, the disclosed cold sprayed powder metallurgy preform includes a cold sprayed body with an outer surface having a first metallic powder composition and a cold sprayed canning layer applied over at least a portion of the outer surface of the cold sprayed body having a second metallic powder composition and a porosity of at most 3 percent.

Figure 4A:
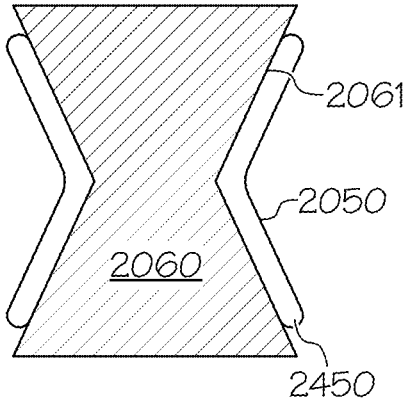
Figure 4B:
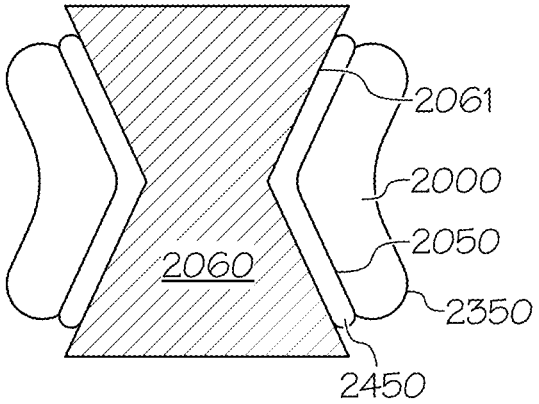
Figure 4C:
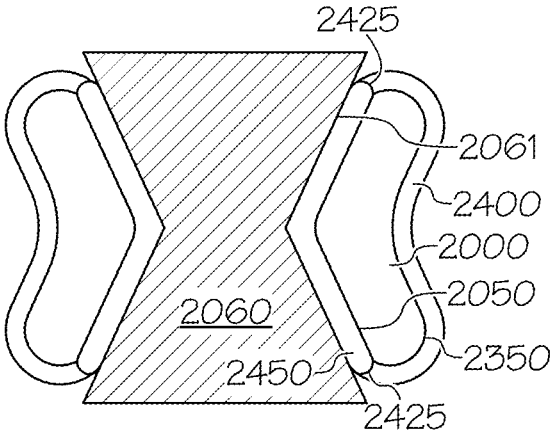
Figure 5A:
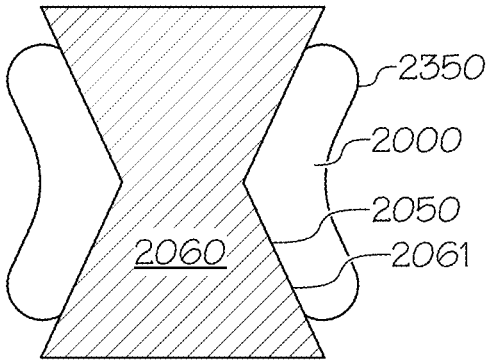
Figure 5B:
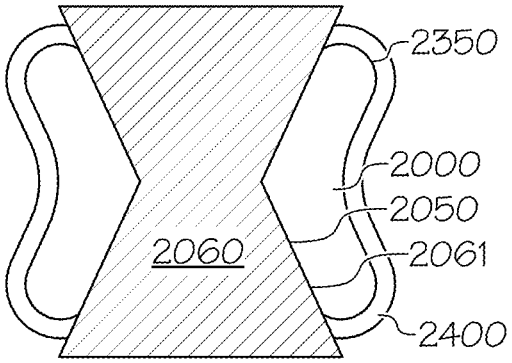
Figure 6A:
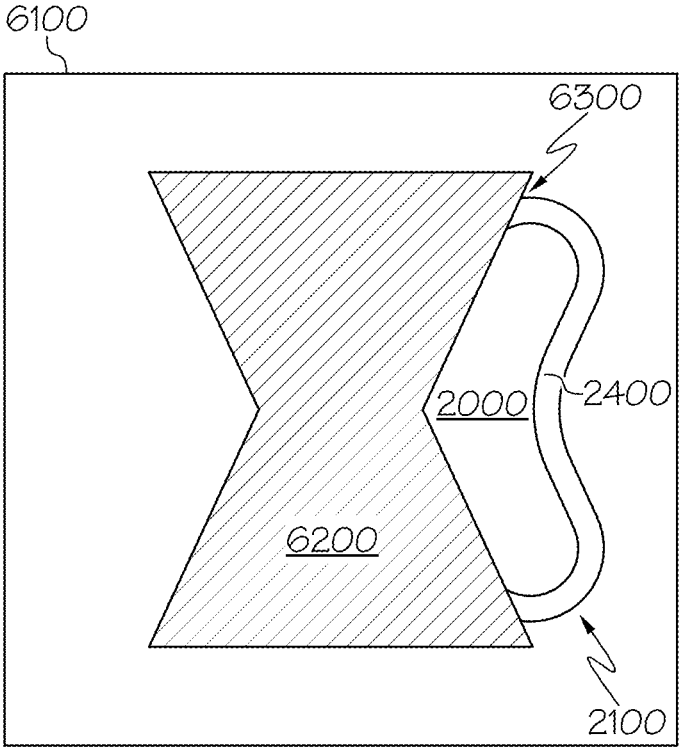
Figure 6B:
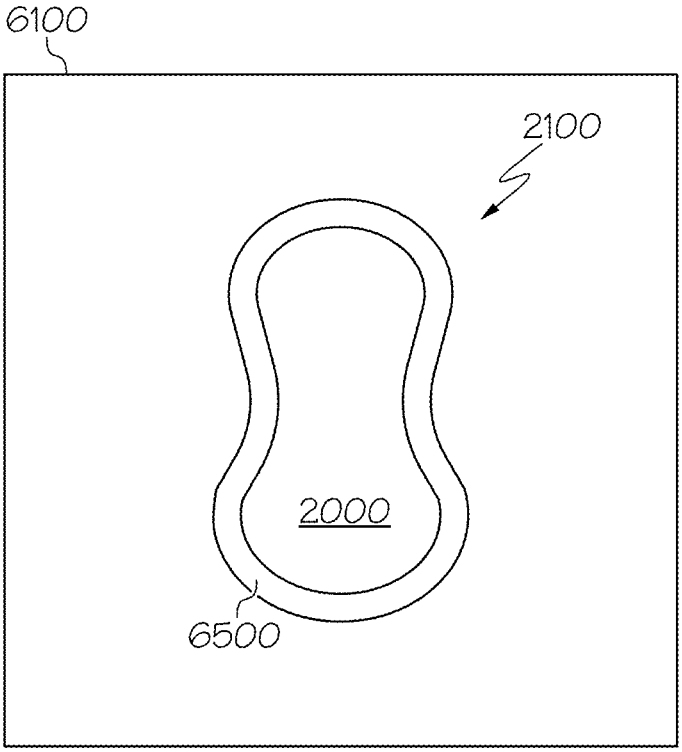
Figure 7A:
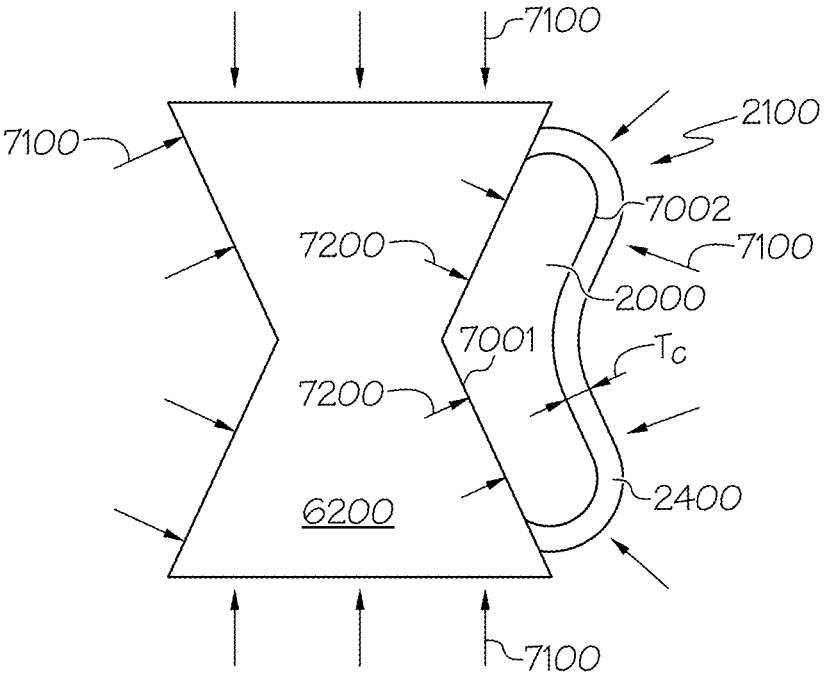
Figure 7B:
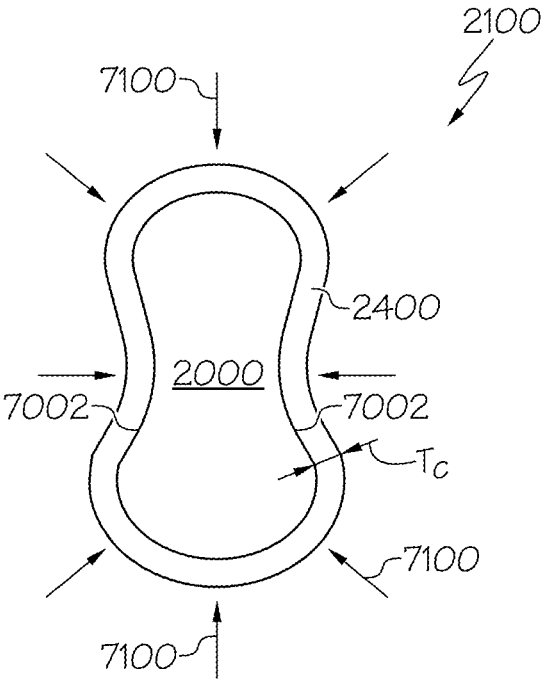
Figure 8:
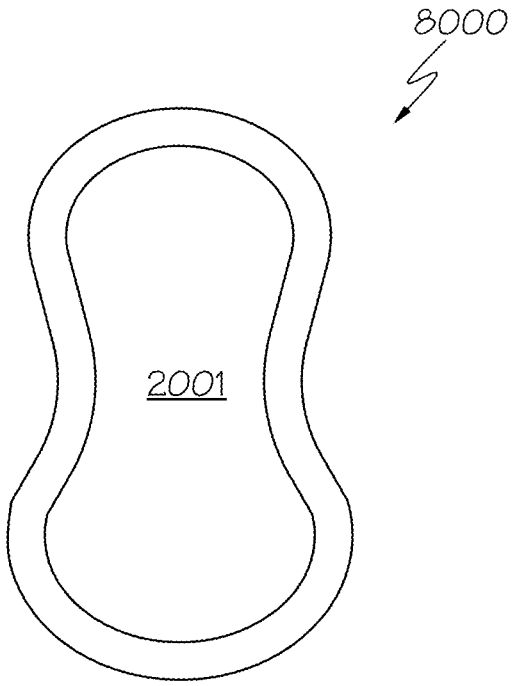
Figure 9A:
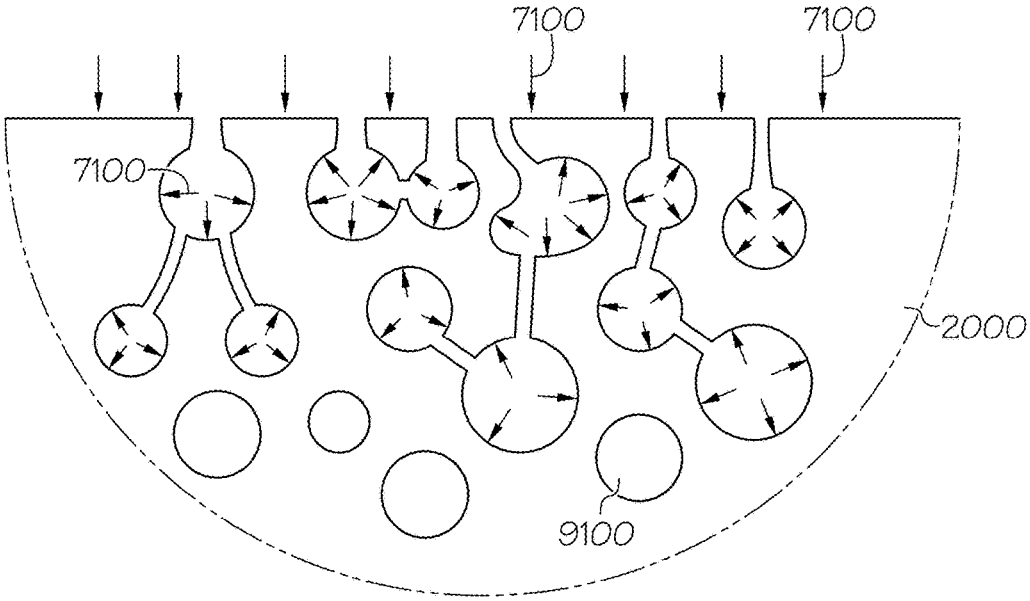
Figure 9B:
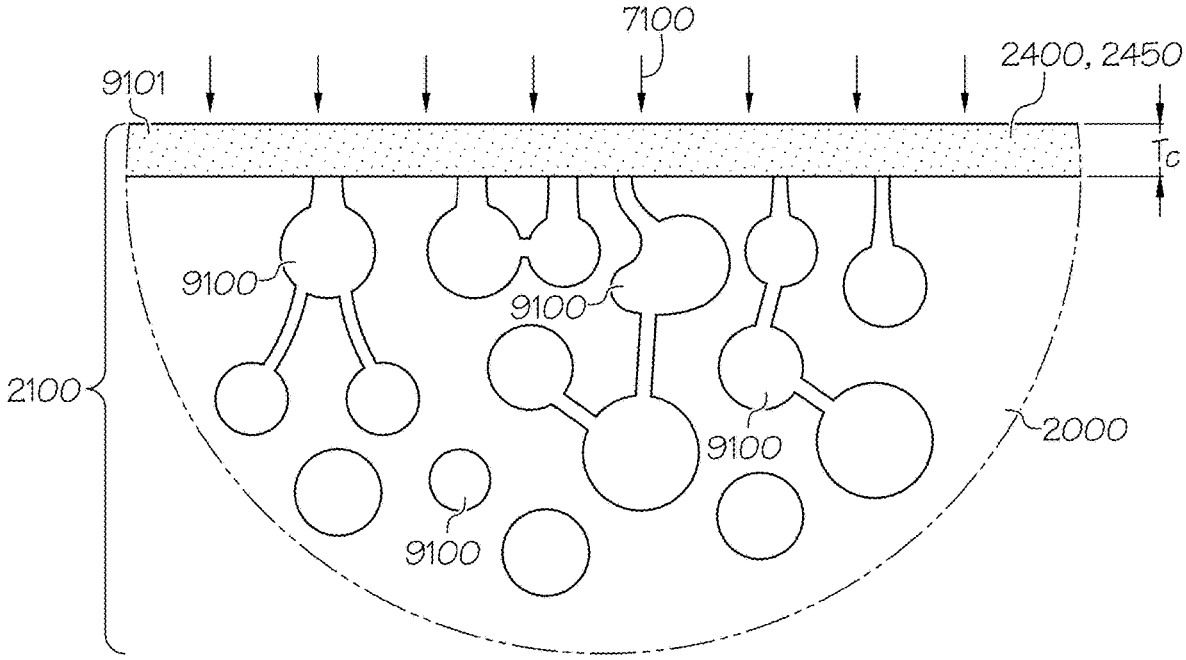
Figure 10A:
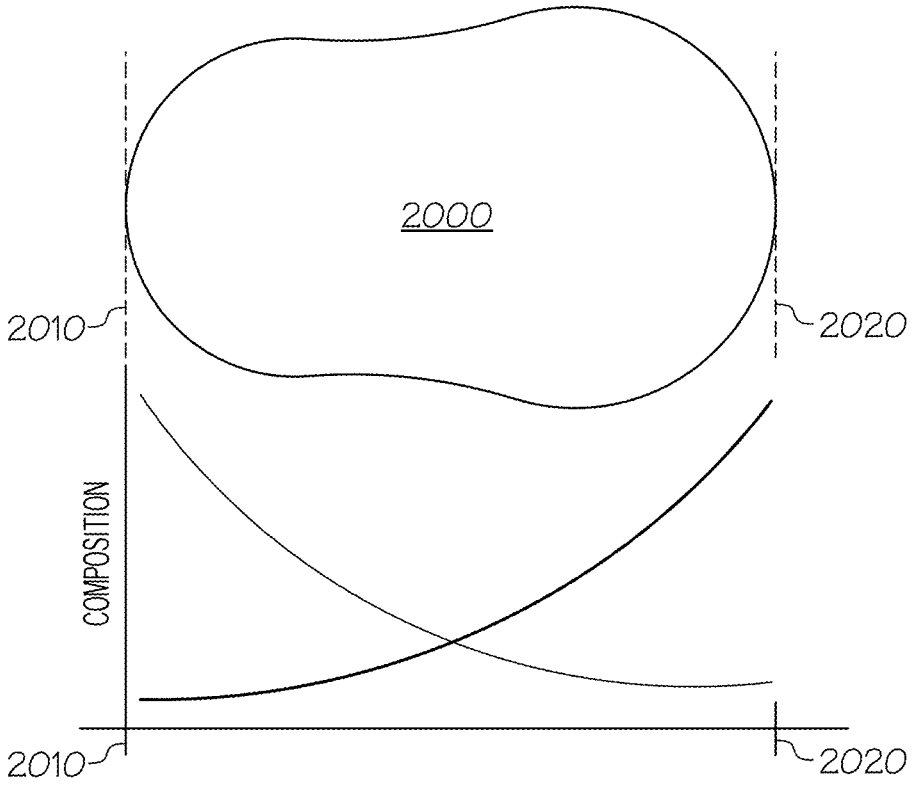
Figure 10B:
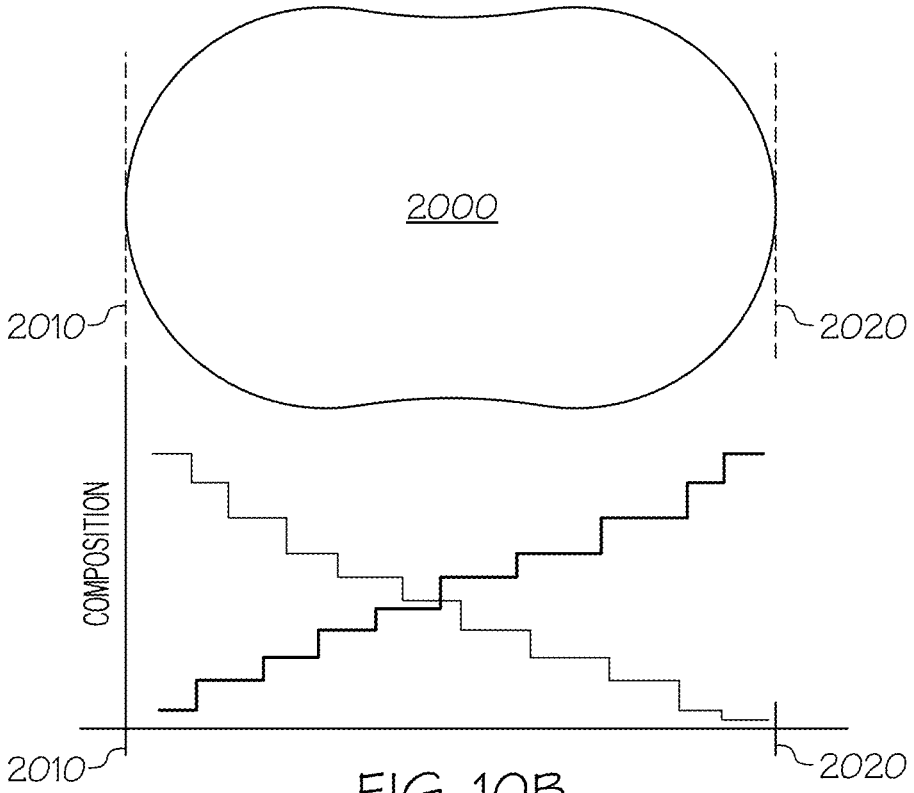
Figure 11:
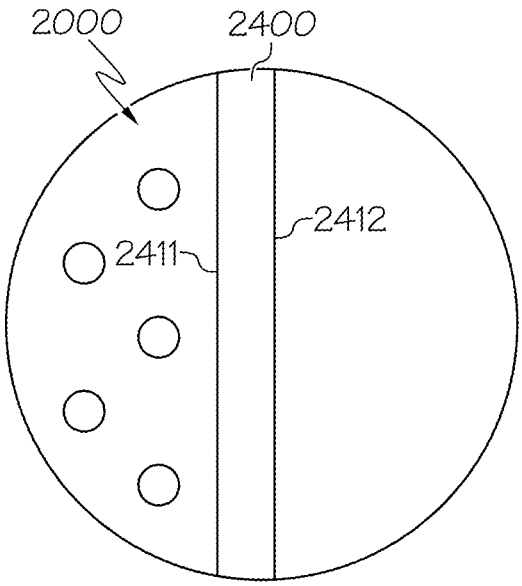
Figure 12:
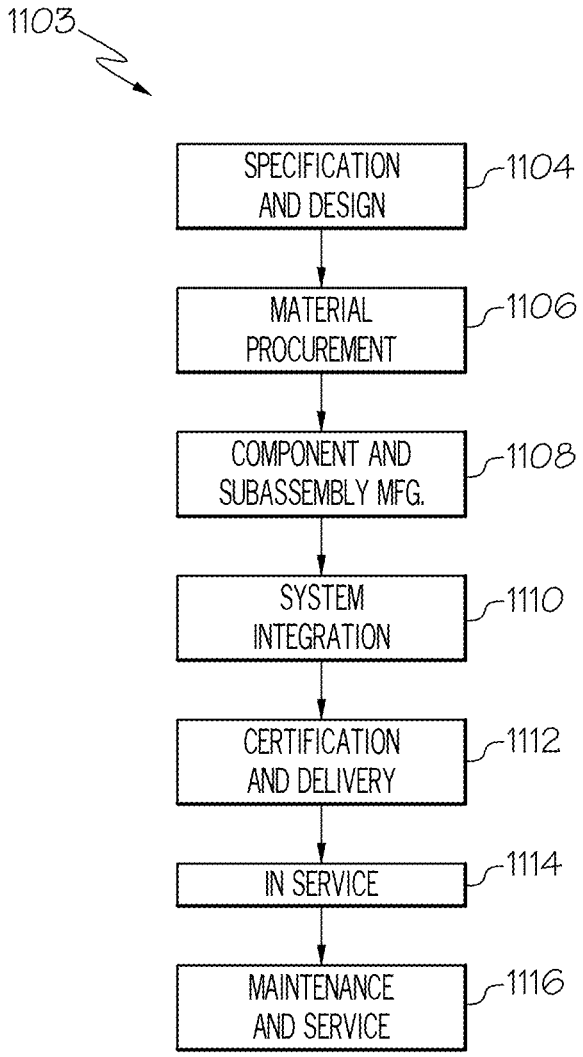
Figure 13:
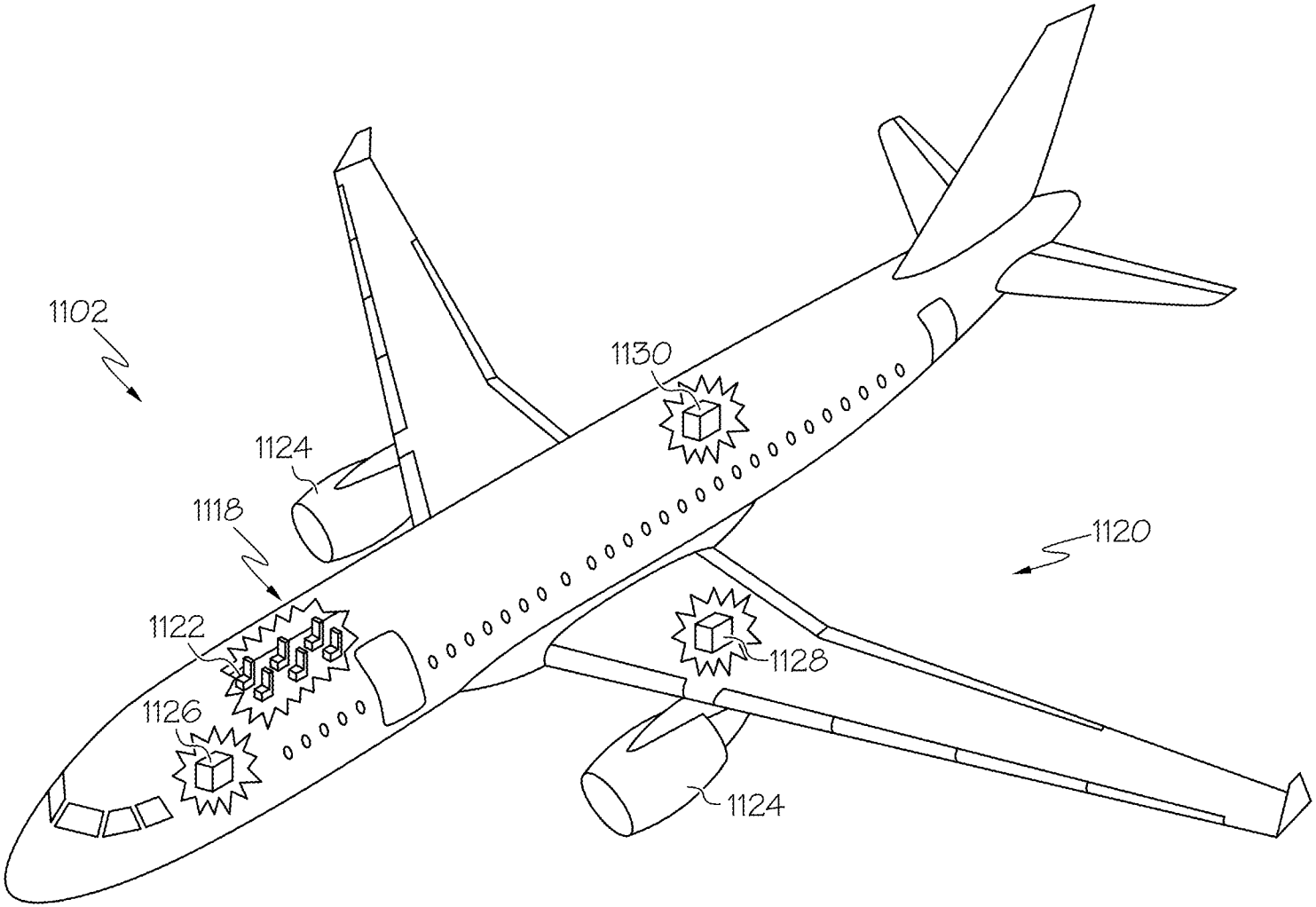

3C is a cross-sectional schematic view of a cold sprayed structure powder metallurgy preform on a non-mandrel tool with a de-bonding layer;

FIG. 4A is a cross-sectional schematic view of a pre-applied cold sprayed canning layer;

FIG. 4B is a cross-sectional schematic view of a cold sprayed body on the pre-applied cold sprayed canning layer;

FIG. 4C is a close-up cross-sectional schematic view of a cold sprayed canning layer on the cold sprayed body on the pre-applied cold sprayed canning layer;

FIG. 5A is a cross-sectional schematic view of a cold sprayed body on a tool;

FIG. 5B is a cross-sectional schematic view of a cold sprayed canning layer on a cold sprayed body on a tool;

FIG. 6A is a schematic diagram illustrating an autoclave system including a cold sprayed powder metallurgy preform on a tool;

FIG. 6B is a schematic diagram illustrating an autoclave system including a cold sprayed powder metallurgy preform without a tool;

FIG. 7A is a schematic diagram illustrating direction of an isostatic pressure during a hot isostatic pressing of a cold sprayed powder metallurgy preform on a tool;

FIG. 7B is a schematic diagram illustrating direction of an isostatic pressure during a hot isostatic pressing of a cold sprayed powder metallurgy preform without a tool;

FIG. 8 is a schematic view of a hot isostatic pressed (HIPed) cold sprayed powder metallurgy preform without a tool;

FIG. 9A is a schematic diagram depicting isostatic pressure applied to the cold sprayed body without a cold sprayed canning layer;

FIG. 9B is a schematic diagram depicting isostatic pressure applied to the cold sprayed body with a cold sprayed canning layer;

FIG. 10A is a graph showing continuous compositional gradient of a cold sprayed body;

FIG. 10B is a graph showing non-continuous compositional gradient of a cold sprayed body;

FIG. 11 is a close-up schematic view, in cross section, of a cold sprayed canning layer;

FIG. 12 is a block diagram of aircraft production and service methodology; and FIG. 13 is a schematic illustration of an aircraft.

DETAILED DESCRIPTION

Figure 1A:
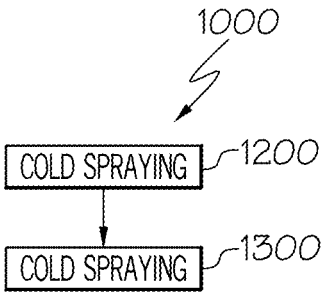
FIG. 1A is a flow diagram depicting one example of the disclosed method for manufacturing cold sprayed powder metallurgy preform.

Referring to FIG. 1A, one example of the disclosed method for manufacturing a cold sprayed powder metallurgy preform, generally designated 1000, includes cold spraying 1200 a first metallic powder composition onto a substrate 2050 to yield a cold sprayed body and cold spraying 1300 a second metallic powder composition over the cold sprayed body 2000 to yield a cold sprayed canning layer 2400 on the cold sprayed body 2000. The cold sprayed canning layer 2400 includes a porosity 9100 (FIG. 9) of at most 3 percent.

Additive manufacturing, specifically cold spraying, is generally more cost-effective due to minimal waste and reduced need for additional materials. However, the expense of helium as propellant gas may negate these benefits. Therefore, there is a need to explore more economical alternatives, such as using nitrogen gas as a propellant. However, nitrogen is less effective at accelerating the powder, resulting in a higher porosity 9100 in the cold-sprayed body, which necessitates further processing steps like heat treating and hot isostatic pressing (HIPing) 1400 to achieve desired material properties by reducing porosity 9100.

Figure 1B:
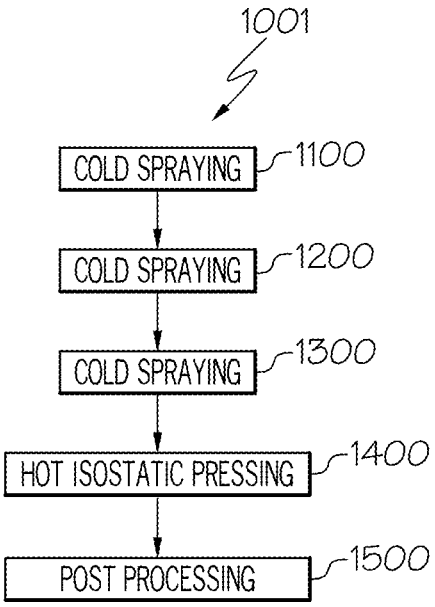
FIG. 1B is a flow diagram depicting another example of the disclosed method for manufacturing cold sprayed powder metallurgy preform.

As shown in FIG. 1B, the disclosed method 1001 may further include additional steps, including, but not limited to, a hot isostatic pressing (HIPing) 1400 to achieve desired material properties by reducing porosity 9100 and a post-processing 1500 to achieve a desired finish. HIPing 1400 the cold sprayed powder metallurgy preform 2100 may yield a HIPed article 8000 (FIG. 8), which includes a HIPed cold sprayed body 2001 with improved mechanical properties by eliminating substantial amount of porosity 9100 from cold spraying 1200. However, it may not be possible to eliminate the porosity 9100 without further measures including, but not limited to canning, if the initial amount of porosity exceeds a certain amount.

When a slower propellant gas is used for economic benefit, the cold sprayed body 2000 manufactured by the disclosed method 1000, 1001 may have a certain amount of porosity 9100, which may necessitate further measures before HIPing 1400. In one example, the cold sprayed body 2000 may have a porosity of at least 3 percent. In another example, the cold sprayed body 2000 may have a porosity of at least 3.5 percent. In another example, the cold sprayed body 2000 may have a porosity of at least 4 percent. In another example, the cold sprayed body 2000 may have a porosity of at least 4.5 percent. In another example, the cold sprayed body 2000 may have a porosity of at least 5 percent. In another example, the cold sprayed body 2000 may have a porosity of at least 6.5 percent. In another example the cold sprayed body 2000 may have a porosity of at least 7 percent. In another example the cold sprayed body 2000 may have a porosity of at least 10 percent. In another example the cold sprayed body 2000 may have a porosity of at least 15 percent.

The higher the porosity 9100 of a cold sprayed body 2000, the less effective the HIPing 1400 would be without a canning layer 2400, 2450. The degree of porosity 9100 of a cold sprayed body 2000 depends on several factors including, but not limited to, the metallic powder composition used, the propellant gas used, and the temperature of the metallic powder. Those skilled in the art may choose proper values for these parameters to achieve a desired final product using the disclosed method.

Referring to FIGS. 2A, 2B, 3A and 3B, cold spraying 1200 a first metallic powder composition to yield a cold sprayed body 2000 may require a substrate 2050 which may be provided in various forms and formats depending on a given project. The substrate 2050 may include, but not limited to, a tool surface 2061 of a tool 2060 and a pre-applied cold sprayed canning layer 2450. The tool 2060 may be provided in various formats, including but not limited to, a mandrel with a flat surface, a mandrel with a complex surface design, a free form with a flat surface, and a free form with a complex surface design. The cold-sprayed body 2000 may be additively manufactured in various shapes and sizes, ranging from simple to very complex geometries.

Depending on the first metallic powder composition used, material properties of a cold sprayed body 2000 may vary greatly. In one non-limiting example, a first metallic powder composition for a cold sprayed body 2000 may be (or may include) at least one of titanium and a titanium alloy. In another non-limiting example, a first metallic powder composition for a cold sprayed body 2000 may be (or may include) at least one of aluminum and an aluminum alloy. In another non-limiting example, the first metallic powder composition of the cold sprayed body 2000 may include at least one of nickel, nickel alloy, and a nickel based super alloy. In another non-limiting example, the first metallic powder composition of the cold sprayed body 2000 may include a complex concentrated alloy.

A cold sprayed body 2000 may be manufactured using one composition without grading. One of the advantages of using additive manufacturing, including cold spraying 1200, is that a cold sprayed body 2000 may be manufactured to have a graded composition. Having a gradient may be desirable in some applications when one side of the cold sprayed body 2000 is exposed to an environment that is different from the environment of the opposite side of the cold sprayed body 2000. Having a gradient may also be desirable when there is a need to have mechanical properties that are different through the cold sprayed body 2000. In one example, the cold sprayed body 2000 may require a variable thermal expansion coefficient to reduce thermal stresses. In one example, the cold sprayed body 2000 may be compositionally graded. In another example, the cold sprayed body 2000 may be functionally graded. In another example, the cold sprayed body 2000 may be both compositionally graded and functionally graded.

In order to achieve this gradient of the cold sprayed body 2000, the composition of the first metallic powder composition may vary during a cold spraying 1200 the first metallic powder composition to yield a cold sprayed body 2000. In other words, the cold spraying 1200 the first metallic powder composition may include varying a composition of the first metallic powder composition over time during the cold spraying 1200 the first metallic powder composition. In non-limiting one example, shown in FIG. 10A, the composition of the first metallic powder composition may vary continuously and gradually without any abrupt change in composition from a first end 2010 of the cold sprayed body 2000 to a second end 2020 of the cold sprayed body 2000. In another example, shown in FIG. 10B, the composition of the first metallic powder composition may vary in the form of a step function, layer by layer, from a first end 2010 of the cold sprayed body 2000 to a second end 2020 of the cold sprayed body 2000. In another example, the composition of the first metallic powder composition may exhibit a combination of both continuous and step function variations from the first end 2010 of the cold sprayed body 2000 to a second end 2020 of the cold sprayed body 2000.

The disclosed method 1000, 1001 involves cold spraying 1200, where high-pressure gas accelerates a first metallic powder composition onto a substrate 2050. The particles deform and bond through diffusion bonding. Temperature plays a crucial role in optimizing this process by influencing two key factors. First, higher temperatures increase gas speed, which in turn enhances particle impact velocity, leading to greater deformation and stronger bonding. Second, elevated temperatures soften the particles, further increasing deformation and reducing porosity. However, this softening can also introduce quenching stresses in the particles, potentially impacting the integrity of the deposited material. Therefore, it is essential to carefully control temperature during cold spraying 1200 to balance these effects and achieve optimal results.

Depending on the propellant gas used, the temperature of cold spraying may vary. In one example, the cold spraying 1200 may be performed at cold temperature without increasing the temperature significantly. In another example, the cold spraying 1200 may be performed at a cold spraying temperature of at least 20 percent of a melting temperature of the first metallic powder composition, in degrees Kelvin. In another example, the cold spraying 1200 may be performed at a cold spraying temperature of at least 25 percent of a melting temperature of the first metallic powder composition, in degrees Kelvin. In another example, the cold spraying 1200 may be performed at a cold spraying temperature of at least 30 percent of the melting temperature of the first metallic powder composition, in degrees Kelvin. In another example, the cold spraying 1200 may be performed at a cold spraying temperature of at least 35 percent of the melting temperature of the first metallic powder composition, in degrees Kelvin. In another example, the cold spraying 1200 may be performed at a cold spraying temperature of at least 40 percent of a melting temperature of the first metallic powder composition, in degrees Kelvin. In another example, the cold spraying 1200 may be performed at a cold spraying temperature of at least 45 percent of the melting temperature of the first metallic powder composition, in degrees Kelvin. In another example, the cold spraying 1200 may be performed at a cold spraying temperature of at least 50 percent of a melting temperature of the first metallic powder composition, in degrees Kelvin. In another example, the cold spraying 1200 may be performed at a cold spraying temperature of at least 60 percent of a melting temperature of the first metallic powder composition, in degrees Kelvin. In another example, the cold spraying 1200 may be performed at a cold spraying temperature of at least 70 percent of a melting temperature of the first metallic powder composition, in degrees Kelvin.

A propellant gas used for cold spraying 1200 may also be a vital determinative factor. As mentioned above, there may be many different types of gas that can be utilized as a propellant gas for cold spraying 1200. In one non-limiting example, the propellant gas may be (or may include) nitrogen gas. In another non-limiting example, the propellant gas may be (or may include) helium gas. In another example, a propellant gas may be (or may include) hydrogen gas. In another example, the propellant gas may be (or may include) air.

Optionally, the cold spraying 1200 the first metallic powder composition may be performed using a propellant gas that is substantially free of helium and dihydrogen. As one example, the propellant gas may consist essentially of atoms having an atomic number greater than 3. In another example, the propellant gas may consist essentially of atoms having an atomic number greater than 5. In another example, the propellant gas may consist essentially of atoms having an atomic number greater than 7. In another example, the propellant gas may consist essentially of atoms having an atomic number greater than 10. In another example, the propellant gas may consist essentially of atoms having an atomic number greater than 12. In another example, the propellant gas may consist essentially of atoms having an atomic number greater than 15. In another example, the propellant gas may consist essentially of atoms having an atomic number greater than 20. In another example, the propellant gas may consist essentially of atoms having an atomic number greater than 25.

One of the advantages of using cold spraying 1200 is the speed and fast turnover time with minimal waste. Those skilled in the art may choose the rate of cold spraying 1200 a first metallic powder composition depending on the given project. In one example, the cold spraying 1200 of the first metallic powder composition may be performed at a deposition rate of at least 0.5 kg/hr. In another example, the cold spraying 1200 of the first metallic powder composition may be performed at a deposition rate of at least 1 kg/hr. In another example, the cold spraying 1200 of the first metallic powder composition may be performed at a deposition rate of at least 2 kg/hr. In another example, the cold spraying 1200 of the first metallic powder composition may be performed at a deposition rate of at least 3 kg/hr. In another example, the cold spraying 1200 of the first metallic powder composition may be performed at a deposition rate of at least 4 kg/hr. In another example, the cold spraying 1200 of the first metallic powder composition may be performed at a deposition rate of at least 5 kg/hr.

Referring to FIGS. 2A, 2B, 3A and 3B, the tool 2060 may be a mandrel in which case the mandrel may rotate while a cold spraying 1200 nozzle travels linearly along the mandrel's axis during cold spraying 1200. A surface speed is a combination of the rotating speed of mandrel and the linear travel speed of the cold spraying 1200 nozzle. The tool 2060 may also be a non-rotating surface, in which case the surface speed may be a combination of a traveling speed of the surface and linear travel speed of the cold spraying 1200 nozzle. In one example, the surface speed may range from 0.001 m/s to about 10 m/s. In another example, the cold spraying 1200 may be performed at the surface speed of at least 0.05 m/s. In another example, the cold spraying 1200 may be performed at the surface speed of at least 0.1 m/s. In another example, the cold spraying 1200 may be performed at the surface speed of at least 0.2 m/s. In another example, the cold spraying 1200 may be performed at the surface speed of at least 0.3 m/s. In another example, the cold spraying 1200 may be performed at the surface speed of at least 0.4 m/s. In another example, the cold spraying 1200 may be performed at the surface speed of at least 0.5 m/s. In another example, the cold spraying 1200 may be performed at the surface speed of at least 0.6 m/s. In another example, the cold spraying 1200 may be performed at the surface speed of at least 0.8 m/s. In another example, the cold spraying 1200 may be performed at the surface speed of at least 1 m/s. In another example, the cold spraying 1200 may be performed at the surface speed of at least 1.2 m/s. In another example, the cold spraying 1200 may be performed at the surface speed of at least 1.5 m/s. In another example, the cold spraying 1200 may be performed at the surface speed of at least 2 m/s.

Referring to FIG. 6A, depending on a given project, those skilled in the art may choose not to remove a tool from a cold sprayed powder metallurgy preform 2100 before HIPing 1400. In one example, an assembly 6300 of high temperature mandrel 6200 and a cold sprayed powder metallurgy preform 2100 may go through HIPing 1400. In one example, the mandrel may be capable of withstanding a temperature of at least 600° C. without mechanical failure. In another example, the mandrel may be capable of withstanding a temperature of at least 700° C. without mechanical failure. In another example, the mandrel may be capable of withstanding a temperature of at least 800° C. without mechanical failure. In another example, the mandrel may be capable of withstanding a temperature of at least 900° C. without mechanical failure. In another example, the mandrel may be capable of withstanding a temperature of at least 1000° C. without mechanical failure. In another example, the mandrel may be capable of withstanding a temperature of at least 1200° C. without mechanical failure.

In another example, the mandrel may be capable of withstanding a pressure of at least 50 MPa without mechanical failure. In another example, the mandrel may be capable of withstanding a pressure of at least 100 MPa without mechanical failure. In another example, the mandrel may be capable of withstanding a pressure of at least 120 MPa without mechanical failure. In another example, the mandrel may be capable of withstanding a pressure of at least 140 MPa without mechanical failure. In another example, the mandrel may be capable of withstanding a pressure of at least 160 MPa without mechanical failure. In another example, the mandrel may be capable of withstanding a pressure of at least 180 MPa without mechanical failure. In another example, the mandrel may be capable of withstanding a pressure of at least 200 MPa without mechanical failure.

Still referring to 6A, if an assembly 6300 of a cold sprayed powder metallurgy preform 2100 and a high temperature mandrel 6200 is intended to go through HIPing 1400, there may not be pre-applied cold sprayed canning layer 2450 before cold spraying 1200 a first metallic powder composition to yield a cold sprayed body 2000. Steps of the cold spraying 1200 without a pre-applied cold sprayed canning layer 2450 is well illustrated in FIGS. 5A and 5B. A first metallic powder composition is cold sprayed directly onto a tool 2060 and then a second metallic powder composition is cold sprayed over at least a portion of an outer surface 2350 of a cold sprayed body 2000.

On the other hand, if a cold sprayed powder metallurgy preform 2100 is an assembly of a cold sprayed body 2000 and a can 6500, the cold sprayed powder metallurgy preform 2100 is removed from a tool 2060 before HIPing 1400 as shown in FIG. 6B. Steps of cold spraying 1300 with a pre-applied cold sprayed canning layer 2450 is well illustrated in FIGS. 4A, 4B and 4C. In one example, it may start by cold spraying 1100 a second metallic powder composition onto a tool 2060 to yield a pre-applied cold sprayed canning layer 2450 followed by cold spraying 1200 a first metallic powder composition onto the pre-applied cold sprayed canning layer 2450 to yield a cold sprayed body 2000 on the pre-applied cold sprayed canning layer 2450. Next step may involve cold spraying 1300 the second metallic powder composition onto the cold sprayed body 2000. In another example, it may start by cold spraying 1100 a third metallic powder composition onto a tool 2060 to yield a pre-applied cold sprayed canning layer 2450 followed by cold spraying 1200 a first metallic powder composition onto the pre-applied cold sprayed canning layer 2450 to yield a cold sprayed body 2000 on the pre-applied cold sprayed canning layer 2450. Next step may involve cold spraying 1300 the second metallic powder composition onto the cold sprayed body 2000.

Figure 2A:
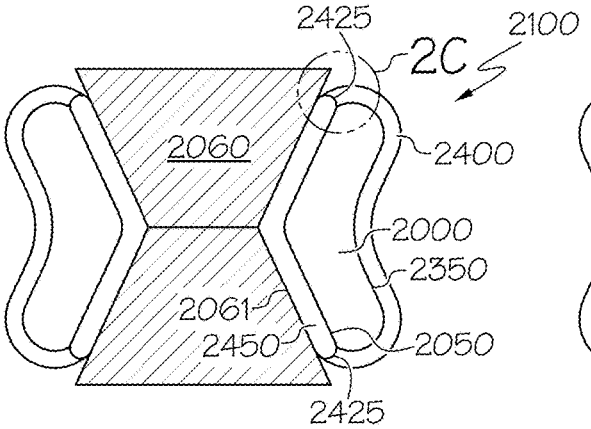
FIG. 2A is a cross-sectional schematic view of a cold sprayed structure powder metallurgy preform on a mandrel with a pre-applied cold sprayed canning layer.
Figure 2B:
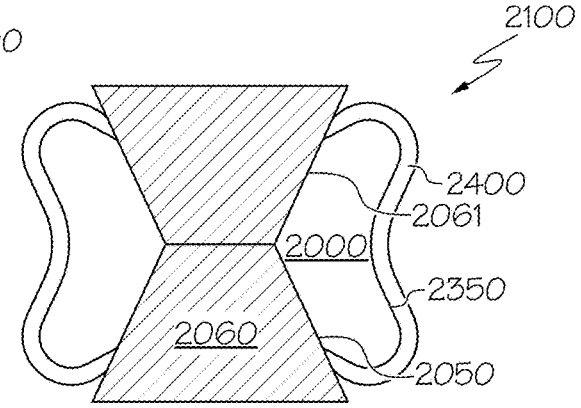
FIG. 2B is a cross-sectional schematic view of a cold sprayed structure powder metallurgy preform on a mandrel without a pre-applied cold sprayed canning layer.
Figure 2C:
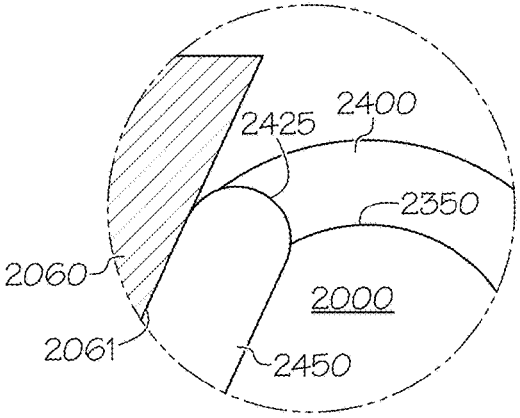
FIG. 2C is a close-up cross-sectional schematic view of a joint area.
Figure 2D:
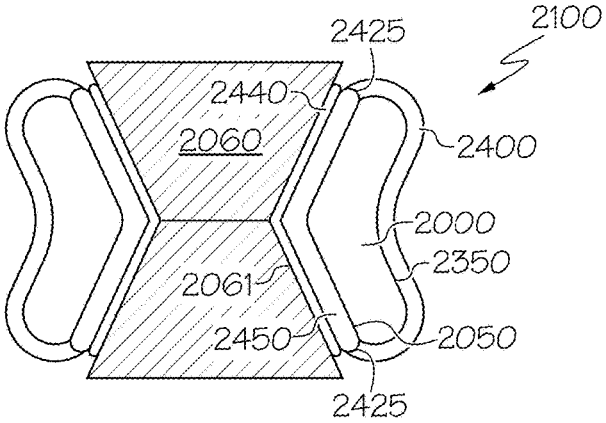
FIG. 2D is a cross-sectional schematic view of a cold sprayed structure powder metallurgy preform on a mandrel with a de-bonding layer.
Figure 3A:
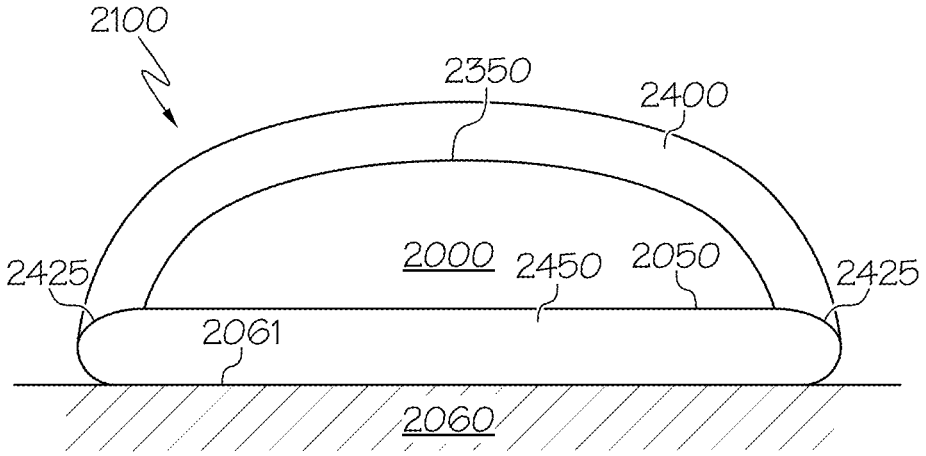
FIG. 3A is a cross-sectional schematic view of a cold sprayed structure powder metallurgy preform on a non-mandrel tool with a pre-applied cold sprayed canning layer.
Figure 3B:
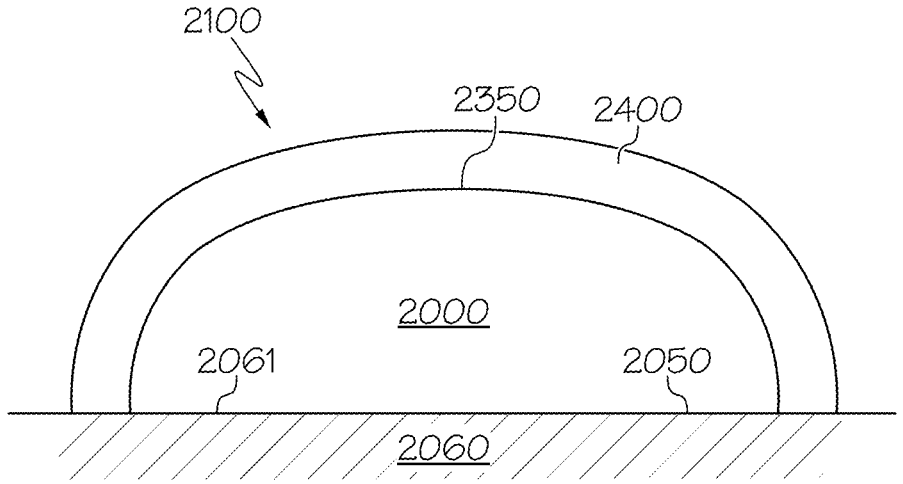
FIG. 3B is a cross-sectional schematic view of a cold sprayed structure powder metallurgy preform on a non-mandrel tool without a pre-applied cold sprayed canning layer.
Figure 3C:
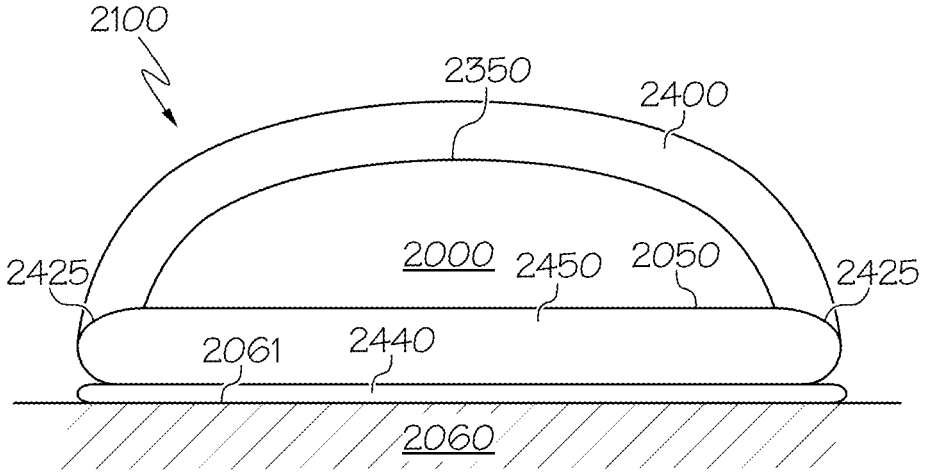

Referring to FIGS. 2D and 3C, to facilitate detachment from the tool surface 2061, a de-bonding layer 2440 may be cold sprayed onto the tool surface 2061 before cold spraying 1100, 1200 the first or second metallic powder composition. The cold-sprayed de-bonding layer 2440 may exhibit low bond strength to the tool surface, allowing for easier release. Those skilled in the art may choose an appropriate material and cold-spraying parameters for the de-bonding layer 2440. Any material that enables safe and easy detachment may be desirable. In one example, commercially pure aluminum may be used for a de-bonding layer that detaches without damaging the tool 2060.

Referring to FIGS. 9A and 9B, one challenge of using a cold sprayed body 2000 for HIPing 1400 stems from the fact that the aforementioned porosity 9100 may provide an unintended surface area that is affected by the isostatic pressure during HIPing 1400. If the pressure is applied within the porosity 9100, instead of compressively eliminating the porosity, it exerts an outward expansion force from the porosity 9100 and may disrupt the integrity of the structure from the inside. Thus, it is desirable to apply at least one additional layer, a canning layer 2400, 2450, as a barrier between the cold sprayed body 2000 and the source of the isostatic pressure 7100. Compared to the cold sprayed body 2000 in FIG. 9A without a canning layer 2400, 2450, the cold sprayed body 2000 in FIG. 9B with a canning layer 2400, 2450 may be a more desirable preform for HIPing 1400 due to its ability to transfer isostatic pressure 7100 to the cold sprayed body 2000 without allowing the isostatic pressure to affect the porosity 9100.

Referring to FIGS. 7A, 7B and 9B, a canning layer 2400, 2450 may have material characteristics that can serve its purpose which may include, but not limited to, transferring isostatic pressure 7100 to a cold sprayed body 2000. The cold sprayed body 2000 is at least partially encapsulated by the canning layer 2400, 2450, during HIPing 1400. In other words, the canning layer 2400, 2450 may need to have material properties that can withstand HIPing 1400 temperatures and pressures. In one example, a canning layer 2400, 2450 may be capable of withstanding a temperature of at least 600° C. without mechanical failure. In another example, a canning layer 2400, 2450 may be capable of withstanding a temperature of at least 700° C. without mechanical failure. In another example, a canning layer 2400, 2450 may be capable of withstanding a temperature of at least 800° C. without mechanical failure. In another example, a canning layer 2400, 2450 may be capable of withstanding a temperature of at least 900° C. without mechanical failure. In another example, a canning layer 2400, 2450 may be capable of withstanding a temperature of at least 1000° C. without mechanical failure. In another example, a canning layer 2400, 2450 may be capable of withstanding a temperature of at least 1100° C. without mechanical failure. In another example, a canning layer 2400, 2450 may be capable of withstanding a temperature of at least 1200° C. without mechanical failure.

In another example, a canning layer 2400, 2450 may be capable of withstanding a pressure of at least 50 MPa without mechanical failure. In another example, a canning layer may be capable of withstanding a pressure of at least 100 MPa without mechanical failure. In another example, a canning layer may be capable of withstanding a pressure of at least 120 MPa without mechanical failure. In another example, a canning layer may be capable of withstanding a pressure of at least 140 MPa without mechanical failure. In another example, a canning layer may be capable of withstanding a pressure of at least 160 MPa without mechanical failure. In another example, a canning layer may be capable of withstanding a pressure of at least 180 MPa without mechanical failure. In another example, a canning layer may be capable of withstanding a pressure of at least 200 MPa without mechanical failure.

Still referring to FIGS. 7A, 7B and 9B, a canning layer 2400, 2450 may also have a thickness sufficient to provide structure rigidity without allowing an isostatic pressure 7100 to penetrate to the porosity 9100 (FIG. 9A), while remaining soft enough to deform with the isostatic pressure 7100. The thickness of the canning layer 2400, 2450 may vary. Those skilled in the art may need to determine a proper thickness depending on a given project and its specifications. In one example, the average thickness $T_C$ may be set to at least 0.02 mm. In another example, the average thickness $T_C$ may be set to at least 0.1 mm. In another example, the average thickness $T_C$ may be set to at least 0.5 mm. In another example, the average thickness $T_C$ may be set to at least 1 mm. In another example, the average thickness $T_C$ may be set to at least 1.5 mm. In another example, the average thickness $T_C$ may be set to at least 2 mm. In another example, the average thickness $T_C$ may be set to at least 2.5 mm. In another example, the average thickness $T_C$ may be set to at least 3 mm. In another example, the average thickness $T_C$ may be set to at least 3.5 mm.

Generally referring to FIGS. 2A, 3A, 4C and 6B, a cold sprayed body 2000 may be fully enclosed by an assembly of a pre-applied cold sprayed canning layer 2450 and a cold sprayed canning layer 2400, at least partially joined at a joint 2425 (FIG. 2C), forming a cold sprayed powder metallurgy preform 2100. In one example, the second metallic powder composition used in cold spraying 1300 the cold sprayed canning layer 2400 may be substantially the same metallic composition as the metallic powder used in cold spraying the pre-applied cold sprayed canning layer 2450. In another example, the second metallic powder composition used in cold spraying 1300 the cold sprayed canning layer 2400 may be substantially different from the metallic powder used in cold spraying the pre-applied cold sprayed canning layer 2450. the cold sprayed canning layer 2400 and pre-applied the cold sprayed canning layer 2450 may be at least partially metallurgically joined at the joint 2425.

Generally referring to FIGS. 2B, 3B, 5B, 6A and 7A, a cold sprayed body 2000 may be cold sprayed 1200 directly onto a tool surface 2061 of a tool 2060 without a pre-applied cold sprayed canning layer 2450. In which case, the tool 2060 itself may act as a barrier between the cold sprayed body 2000 and the source of an isostatic pressure 7100 preventing the isostatic pressure 7100 from affecting a porosity 9100 during HIPing 1400 as shown in FIG. 6A. In one non-limiting example, a high temperature mandrel 6200 is the tool 2060 that acts as a barrier between the cold sprayed body 2000 and the source of an isostatic pressure 7100.

FIG. 7A illustrates pressures 7100, 7200 applied to a cold sprayed powder metallurgy preform 2100 without a pre-applied cold sprayed canning layer 2450 in an autoclave 6100 during HIPing 1400. Due to the fact that the isostatic pressure 7100 is applied on the surface of the high temperature mandrel 6200, a transferred pressure 7200 applied to an un-canned surface 7001 of the cold sprayed body 2000 may be substantially different from the isostatic pressure 7100 applied on a canned surface 7002 of the cold sprayed body 2000. Depending on a given project, those skilled in the art may need to use a cold sprayed powder metallurgy preform 2100 with a high temperature mandrel 6200 for HIPing 1400. In another example, shown in FIG. 7B, isostatic pressure 7100 is applied to a cold-sprayed powder metallurgy preform 2100 with a cold-sprayed canning layer 2400 on all sides of a cold-sprayed body 2000. In this example, the cold-sprayed powder metallurgy preform 2100 is removed from a tool 2060 before HIPing 1400.

Cold spraying 1300 a second metallic powder composition may yield a canning layer 2400, 2450 that has substantially low canning layer porosity 9101. Due to the nature of the cold spraying 1300, very small amount of canning layer porosity 9101 may be inevitable. Those skilled in the art may need to choose appropriate parameters for cold spraying 1300 to yield a canning layer 2400, 2450 with a minimum amount of canning layer porosity 9101. The canning layer 2400, 2450 may need to be soft enough to create a minimum amount of canning layer porosity 9101 while being stable enough to withstand conditions of HIPing 1400.

Referring back to FIGS. 9A and 9B, in order to serve its purpose, a canning layer 2400, 2450 may need to prevent isostatic pressure from affecting a porosity 9100 of a cold sprayed body 2000. In one example, a cold sprayed canning layer 2400, 2450 may have a canning layer porosity 9101 of at most 5 percent. In another example, a canning layer 2400, 2450 may have a canning layer porosity 9101 of at most 4.5 percent. In another example, a canning layer 2400, 2450 may have a canning layer porosity 9101 of at most 4 percent. In another example, a canning layer 2400, 2450 may have a canning layer porosity 9101 of at most 3.5 percent. In another example, a canning layer 2400, 2450 may have a canning layer porosity 9101 of at most 3 percent. In another example, a canning layer 2400, 2450 may have a canning layer porosity 9101 of at most 2.5 percent. In another example, a canning layer 2400, 2450 may have a canning layer porosity 9101 of at most 2 percent. In another example, a canning layer 2400, 2450 may have a canning layer porosity 9101 of at most 1.5 percent. In another example, a canning layer 2400, 2450 may have a canning layer porosity 9101 of at most 1 percent. In another example, a canning layer 2400, 2450 may have a canning layer porosity 9101 of at most 0.5 percent. In another example, a canning layer 2400, 2450 may have a canning layer porosity 9101 of at most 0.2 percent.

A canning layer 2400, 2450 may be used when the cold sprayed body 2000 has a porosity 9100 of a certain percentage that makes it challenging to achieve better material properties by going through HIPing 1400 by itself without a canning layer 2400, 2450. In one example, a cold sprayed powder metallurgy preform 2100 may have a canning layer porosity 9101 that is substantially different from a porosity 9100 of the cold sprayed body 2000. In another example, a cold sprayed powder metallurgy preform 2100 may have a canning layer porosity 9101 that is substantially the same as a porosity 9100 of the cold sprayed body 2000.

In another example, the porosity 9100 of the cold sprayed body 2000 may be substantially larger than a canning layer porosity 9101 of a cold sprayed canning layer 2400. In another example, a porosity 9100 of the cold sprayed body 2000 may be substantially larger than a canning layer porosity 9101 of a pre-applied cold sprayed canning layer 2450.

Cold spraying 1300 a second metallic powder composition may involve several different key factors that may affect properties of a cold sprayed canning layer 2400. Those factors may include, but are not limited to, material used, composition, propellant gas used, temperature of the powder, and speed and rate of the cold spraying 1300, among other possible factors.

Depending on a second metallic powder composition used, material properties of a cold sprayed canning layer 2400 may vary greatly. In one example, the second metallic powder composition may include, but not limited to, at least one of a refractory metal and a refractory metal alloy. In another example, the second metallic powder composition may include, but not limited to, titanium. In another example, the second metallic powder composition may include, but not limited to, aluminum. In another example, the second metallic powder composition may include, but not limited to, niobium. In another example, the second metallic powder composition may include, but not limited to tantalum. In another example, the second metallic powder composition may include, but not limited to, an austenitic steel. In another example, the second metallic powder composition may include, but not limited to, a transition metal. In another example, the second metallic powder composition may include, but not limited to, a refractory metal.

A cold sprayed canning layer 2400 may be cold sprayed using graded material. In one example, the cold sprayed canning layer 2400 may be manufactured with a compositionally graded material. In another example, the cold sprayed canning layer 2400 may be manufactured with a functionally graded material. In another example, the cold sprayed canning layer 2400 may be both compositionally graded and a functionally graded.

Referring to FIG. 11, a composition of a second metallic powder composition may vary over time during a cold spraying 1300 the second metallic powder composition to yield a cold sprayed canning layer 2400. In one example, the composition of the second metallic powder composition may vary continuously and gradually without any abrupt change in composition from a first side 2411 of the cold sprayed canning layer 2400 to a second side 2412 of the cold sprayed canning layer 2400. In another example, the composition of the second metallic powder composition may vary in the form of a step function, layer by layer, from a first side 2411 of the cold sprayed canning layer 2400 to a second side 2412 of the cold sprayed canning layer 2400. In another example, the composition of the second metallic powder composition may exhibit a combination of both continuous and step function variations from a first end 2010 of the cold sprayed body 2000 to a second end 2020 of the cold sprayed body 2000.

The disclosed method 1000, 1001 involves cold spraying 1300 using high-pressure gas to accelerate a second metallic powder composition onto a cold sprayed body 2000, where the particles deform and bond. To optimize the bonding process, it is desirable for those skilled in the art to understand the role of temperature in particle behavior. Different particles at different temperatures will result in varying degrees of deformation, which impacts the overall quality of the final product. Thus, it is desirable to use a proper temperature during the cold spraying 1300.

In one example, the cold spraying 1300 may be performed at a cold spraying temperature of at least 20 percent of a melting temperature of the second metallic powder composition, in degrees Kelvin. In another example, the cold spraying 1300 may be performed at a cold spraying temperature of at least 25 percent of a melting temperature of the second metallic powder composition, in degrees Kelvin. In another example, the cold spraying 1300 may be performed at a cold spraying temperature of at least 30 percent of a melting temperature of the second metallic powder composition, in degrees Kelvin. In another example, the cold spraying 1300 may be performed at a cold spraying temperature of at least 35 percent of a melting temperature of the second metallic powder composition, in degrees Kelvin. In another example, the cold spraying 1300 may be performed at a cold spraying temperature of at least 40 percent of a melting temperature of the second metallic powder composition, in degrees Kelvin. In another example, the cold spraying 1300 may be performed at a cold spraying temperature of at least 45 percent of a melting temperature of the second metallic powder composition, in degrees Kelvin. In another example, the cold spraying 1300 may be performed at a cold spraying temperature of at least 50 percent of a melting temperature of the second metallic powder composition, in degrees Kelvin. In another example, the cold spraying 1300 may be performed at a cold spraying temperature of at least 60 percent of a melting temperature of the second metallic powder composition, in degrees Kelvin. In another example, the cold spraying 1300 may be performed at a cold spraying temperature of at least 70 percent of a melting temperature of the second metallic powder composition, in degrees Kelvin.

The propellant gas used for cold spraying 1300 may also be a determinative factor for the final properties of a cold sprayed canning layer 2400. As mentioned previously, there may be many different types of gas that can be utilized as a propellant gas for cold spraying 1300. In one non-limiting example, the propellant gas may be (or may include) nitrogen gas. In another non-limiting example, a propellant gas may be (or may include), helium gas. In another non-limiting example, a propellant gas may be (or may include) hydrogen gas. In another example, a propellant gas may be (or may include) air.

Those skilled in the art may choose the rate of cold spraying 1300 the second metallic powder composition depending on the given project. In one example, the cold spraying 1300 of the second metallic powder composition may be performed at a deposition rate of at least 0.1 kg/hr. In another example, the cold spraying 1300 of the second metallic powder composition may be performed at a deposition rate of at least 1 kg/hr. In another example, the cold spraying 1300 of the second metallic powder composition may be performed at a deposition rate of at least 2 kg/hr. In another example, the cold spraying 1300 of the second metallic powder composition may be performed at a deposition rate of at least 3 kg/hr. In another example, the cold spraying 1300 of the second metallic powder composition may be performed at a deposition rate of at least 4 kg/hr. In another example, the cold spraying 1300 of the second metallic powder composition may be performed at a deposition rate of at least 5 kg/hr.

Referring to FIGS. 2A, 2B, 3A, and 3B, the tool 2060 may be a mandrel in which case the mandrel may rotate while a cold spraying 1300 nozzle travels linearly along the mandrel's axis during cold spraying 1300. A surface speed is a combination of the rotating speed of mandrel and the linear travel speed of the cold spraying 1300 nozzle. The tool 2060 may also be a non-rotating surface in which case the surface speed may be a combination of a traveling speed of the surface and linear travel speed of the cold spraying 1300 nozzle. In one example, the surface speed of a cold spraying 1300 nozzle may range from 0.001 m/s to about 10 m/s. In another example, the cold spraying 1300 may be performed at the surface speed of at least 0.05 m/s. In another example, the cold spraying 1300 may be performed at the surface speed of at least 0.1 m/s. In another example, the cold spraying 1300 may be performed at the surface speed of at least 0.2 m/s. In another example, the cold spraying 1300 may be performed at the surface speed of at least 0.3 m/s. In another example, the cold spraying 1300 may be performed at the surface speed of at least 0.4 m/s. In another example, the cold spraying 1300 may be performed at the surface speed of at least 0.5 m/s. In another example, the cold spraying 1300 may be performed at the surface speed of at least 0.6 m/s. In another example, the cold spraying 1300 may be performed at the surface speed of at least 0.8 m/s. In another example, the cold spraying 1300 may be performed at the surface speed of at least 1 m/s. In another example, the cold spraying 1300 may be performed at the surface speed of at least 1.2 m/s. In another example, the cold spraying 1300 may be performed at the surface speed of at least 1.5 m/s. In another example, the cold spraying 1300 may be performed at the surface speed of at least 2 m/s.

Referring back to FIG. 1B, the disclosed method 1000, 1001 may further include post processing 1500 to meet desired specifications of a final product after HIPing 1400. This may involve various processes, including but not limited to, removing a tool 2060, removing a pre-applied cold sprayed canning layer 2450, removing a cold sprayed canning layer 2400, machining, etching, polishing, heat treating, coating, and synthesizing. Those skilled in the art may choose to perform any mechanical, chemical, or biological process necessary to achieve a final product that meets all required specifications.

Examples of the disclosure may be described in the context of an aircraft manufacturing and service method 1103, as shown in FIG. 13, and an aircraft 1102, as shown in FIG. 14. During pre-production, the aircraft manufacturing and service method 1103 may include specification and design 1104 of the aircraft 1102 and material procurement 1106. During production, component/subassembly manufacturing 1108 and system integration 1110 of the aircraft 1102 takes place. Thereafter, the aircraft 1102 may go through certification and delivery 1112 in order to be placed in service 1114. While in service by a customer, the aircraft 1102 is scheduled for routine maintenance and service 1116, which may also include modification, reconfiguration, refurbishment and the like.

Each of the processes of method 1103 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 14, the aircraft 1102 produced by example method 1103 may include an airframe 1118 with a plurality of systems 1120 and an interior 1122. Examples of the plurality of systems 1120 may include one or more of a propulsion system 1124, an electrical system 1126, a hydraulic system 1128, and an environmental system 1130. Any number of other systems may be included.

The disclosed methods for manufacturing cold spayed powder metallurgy preforms may be employed during any one or more of the stages of the aircraft manufacturing and service method 1103. As one example, components or subassemblies corresponding to component/subassembly manufacturing 1108, system integration 1110, and/or maintenance and service 1116 may be assembled using the disclosed methods for manufacturing cold spayed powder metallurgy preforms. As another example, the airframe 1118 may be constructed using the disclosed methods for manufacturing cold spayed powder metallurgy preforms. Also, one or more method examples may be utilized during component/subassembly manufacturing 1108 and/or system integration 1110, for example, by substantially expediting assembly of or reducing the cost of an aircraft 1102, such as the airframe 1118 and/or the interior 1122. Similarly, one or more method examples may be utilized while the aircraft 1102 is in service, for example and without limitation, to maintenance and service 1116.

Different examples of the disclosed methods for manufacturing cold spayed powder metallurgy preforms include a variety of components, features, and functionalities. It should be understood that the various examples of the disclosed methods for manufacturing cold spayed powder metallurgy preforms disclosed herein may include any of the components, features, and functionalities of any of the other examples of the disclosed methods for manufacturing cold spayed powder metallurgy preforms, and all of such possibilities are intended to be within the scope of the present disclosure.

The disclosed methods for manufacturing cold spayed powder metallurgy preforms are described in the context of aerospace vehicles. However, one of ordinary skill in the art will readily recognize that the disclosed methods for manufacturing cold spayed powder metallurgy preforms are suitable for a variety of applications, and the present disclosure is not limited to aerospace applications. For example, the disclosed methods for manufacturing cold spayed powder metallurgy preforms may be implemented in various types of vehicles including, for example, helicopters, passenger ships, automobiles, marine products (boat, motors, etc.) and the like. Non-vehicle applications are also contemplated.

Although the disclosed methods for manufacturing cold spayed powder metallurgy preforms in an aerospace environment, it is contemplated that the disclosed methods for manufacturing cold spayed powder metallurgy preforms may be implemented in any industry in accordance with the applicable industry standards. The specific method for manufacturing a cold spayed powder metallurgy preform can be selected and tailored depending upon the particular application.

Although various examples of the disclosed methods for manufacturing cold spayed powder metallurgy preform have been shown and described, modifications may occur to those skilled in the art upon reading the specification. The present application includes such modifications and is limited only by the scope of the claims.

What is claimed is:

1. A method for manufacturing a cold sprayed powder metallurgy preform, the method comprising:

cold spraying a first metallic powder composition onto a substrate to yield a cold sprayed body, wherein the cold sprayed body comprises a porosity of at least 4 percent; and cold spraying a second metallic powder composition over the cold sprayed body to yield a cold sprayed canning layer on the cold sprayed body, wherein the cold sprayed canning layer comprises a porosity of at most 3 percent.

2. The method of claim 1 wherein the cold spraying the first metallic powder composition comprises varying a composition of the first metallic powder composition over time during the cold spraying the first metallic powder composition.

3. The method of claim 1 wherein the cold spraying the first metallic powder composition is performed at a surface speed ranging from about 0.001 m/s to about 10 m/s.

4. The method of claim 1 wherein the cold spraying the first metallic powder composition is performed using a propellant gas that is substantially free of helium.

5. The method of claim 1 wherein the cold spraying the first metallic powder composition is performed using a propellant gas that consists essentially of nitrogen.

6. The method of claim 1 wherein the first metallic powder composition comprises at least one of titanium, aluminum, and nickel.

7. The method of claim 1 wherein the cold spraying the first metallic powder composition onto the substrate comprises cold spraying the first metallic powder composition onto a tool surface of a tool.

8. The method of claim 1 wherein the cold spraying the first metallic powder composition onto the substrate comprises cold spraying the first metallic powder composition onto a pre-applied cold sprayed canning layer.

9. The method of claim 8 wherein a composition of the pre-applied cold sprayed canning layer is substantially different from a composition of the cold sprayed body.

10. The method of claim 8 wherein a composition of the pre-applied cold sprayed canning layer is substantially the same material as a composition of the cold sprayed canning layer.

11. The method of claim 8 wherein the pre-applied cold sprayed canning layer comprises a canning layer porosity of at most 2 percent.

12. The method of claim 1 wherein the cold sprayed body comprises a graded composition.

13. The method of claim 1 wherein the second metallic powder composition comprises at least one of titanium, aluminum, niobium, tantalum, and austenitic steel.

14. The method of claim 1 wherein the second metallic powder composition is substantially different from the first metallic powder composition.

15. The method of claim 1 wherein the cold sprayed canning layer comprises a porosity of at most 2 percent.

16. The method of claim 1 wherein the cold sprayed canning layer comprises an average thickness of at least 0.1 mm.

17. A method for manufacturing an article using at least a first metallic powder composition and a second metallic powder composition, the method comprising:

cold spraying the first metallic powder composition onto a substrate to yield a cold sprayed body comprising a porosity of at least 4 percent;

cold spraying the second metallic powder composition over the cold sprayed body to yield a cold sprayed canning layer on the cold sprayed body, the cold sprayed canning layer comprises a porosity of at most 3 percent, wherein the cold sprayed body and the cold sprayed canning layer define a cold sprayed powder metallurgy preform; and hot isostatic pressing the cold sprayed powder metallurgy preform.

18. A method for manufacturing an article, the method comprising:

cold spraying a first metallic powder composition onto a substrate to form a first layer;

cold spraying a second metallic powder composition over the first layer to form a second layer, wherein a porosity of the first layer is greater than a porosity of the second layer;

hot isostatic pressing the first layer and the second layer; and removing at least a portion of the second layer.

19. The method of claim 18, further comprising cold spraying a third metallic powder composition onto the substrate prior to cold spraying the first metallic powder composition to form a third cold sprayed layer disposed between the substrate and the first cold sprayed layer, wherein a porosity of the third cold sprayed layer is less than the porosity of the first cold sprayed layer.

20. The method of claim 18, further comprising cold spraying a de-bonding layer onto a tool surface of the substrate prior to cold spraying the first metallic powder composition.

* * * * *